US007704564B2

(12) United States Patent
DeRegge et al.

(10) Patent No.: US 7,704,564 B2
(45) Date of Patent: Apr. 27, 2010

(54) UV CURING STRUCTURE AND PROCESS

(75) Inventors: Karel DeRegge, Morrison, CO (US); Johan Huwaert, Morrison, CO (US)

(73) Assignee: Garmat USA Inc., Englewood, CO (US)

( * ) Notice: Subject to any disclaimer, the term of this patent is extended or adjusted under 35 U.S.C. 154(b) by 91 days.

(21) Appl. No.: 11/938,723

(22) Filed: Nov. 12, 2007

(65) Prior Publication Data

US 2008/0063807 A1 Mar. 13, 2008

Related U.S. Application Data

(62) Division of application No. 11/194,138, filed on Jul. 28, 2005, now abandoned.

(51) Int. Cl.
*B05D 3/06* (2006.01)

(52) U.S. Cl. ..... 427/508; 427/487

(58) Field of Classification Search ..... 427/487, 427/508

See application file for complete search history.

(56) References Cited

U.S. PATENT DOCUMENTS

| | | | | |
|---|---|---|---|---|
| 1,648,010 | A | 10/1927 | George | |
| 2,688,476 | A | 9/1954 | Mayo | |
| 3,866,334 | A | 2/1975 | Huang | |
| 4,039,019 | A | 8/1977 | Hopper | |
| 4,836,102 | A * | 6/1989 | Cicci | 101/41 |
| 5,836,085 | A | 11/1998 | Ben-Ezra | |
| 6,533,654 | B2 | 3/2003 | DeRegge | |
| 6,633,042 | B1 | 10/2003 | Funken et al. | |
| 6,739,966 | B2 | 5/2004 | DeRegge | |
| 6,777,458 | B1 * | 8/2004 | Jaworek et al. | 522/1 |
| 6,923,911 | B1 * | 8/2005 | Beier et al. | 210/273 |
| 6,924,324 | B2 * | 8/2005 | Gaudl et al. | 522/182 |
| 2002/0033134 | A1 * | 3/2002 | Fannon | 118/667 |
| 2005/0020711 | A1 | 1/2005 | Cook | |
| 2005/0120948 | A1 | 6/2005 | DeRegge | |

OTHER PUBLICATIONS

Radtech Report, "3-D UV Technology for OEM Coatings" Nov./Dec. 2001, pp. 26-29.

(Continued)

*Primary Examiner*—Elena T Lightfoot
(74) *Attorney, Agent, or Firm*—Townsend and Townsend and Crew LLP

(57) ABSTRACT

A light curing structure and related methods are disclosed wherein a framework defining an interior space for containing an object having applied thereon a light-cured material is provided, and means associated with the framework for exposing the object to UV radiation from natural sunlight is used to cure the light-cured material. Preferred embodiments include a booth for applying and curing light-cured materials comprising a housing having a ceiling and walls that define an enclosed interior space for holding an object, means for applying a light-cured material to the object; means for preventing the exposure of the light-cured material to UV radiation during application of the light-cured material to the object, and means for exposing the light-cured material to UV radiation from natural sunlight after application of the light-cured material to the object. Apparatus and methods according to the invention are particularly suited for use with UV-cured paints in the automotive industry.

8 Claims, 4 Drawing Sheets

OTHER PUBLICATIONS

Web page, "Ultraviolet Curing Equipment for Commercial Use" at URL=http://ulstandardsinfonet.ul.com/outscope/2422.html, printed May 17,2005 (1 page).

Web page, Automotive Body Repair News "ABRN" "The 2 Minute Cure" at URL=http://www.abrn.com/abrn/content/printContentPopup.jsp?id=68208, printed May 17, 2005 (4 pages).

Web page, Metal Finishing "Choosing the Right UV-curing Lamp Can Brighten Your Future" at URL=http://www.metalfinishing.com/editors_choice/articles/050405_Maloney.htm, printed May 17,2005 (3 pages).

Web page, Tubular Skylight "The History of Tubular Skylights" at URL=http://www.sunpipe.com/iz10.htm, printed Jun. 2, 2005 (4 pages).

Web page: Industry News—Ciba Specialty Chemicals "Ciba Specialty Chemicals develops new curing technology for novel and improved coatings" at URL=http://www.specialchem4coatings.com/news-trends/displaynews.aspx?id=134, printed Jun. 6, 2005 (1 page).

Web page, Wiley InterScience Journal "Journal of Applied Polymer Science" at URL=http://www3.interscience.wiley.com/cgi-bin/abstract/5005114/ABSTRACT, printed Jun. 6, 2005 (1 page).

Web page, Today's Technology and You "Skylight Tube Solves Lighting Problems" at URL=http:www.lib.niu.edu/ipo/ic000418.html, printed Jun. 7, 2005 (3 pages).

Web page, UV Light Curing "UV Light Technology" at URL=http:www.uv-light.co.uk/applications/materials_curivng/uv_curing.html, printed Jun. 13, 2005 (2 pages).

Garmat® USA, Brochure entitled "3000 Series Spray Booths," published prior to Jul. 28, 2005 (8 pages).

Garmat® USA, Brochure entitled "The Zephyr Spray Booths," published prior to Jul. 28, 2005 (4 pages).

Garmat® USA, Brochure entitled "Closed Top Open Front Spray Booths," published prior to Jul. 28, 2005 (4 pages).

Garmat® USA, Brochure entitled "Paint Mixing Rooms," published prior to Jul. 28, 2005 (2 pages).

Garmat® USA, Brochure entitled "Vehicle Preparation Areas," published prior to Jul. 28, 2005 (2 pages).

Garmat® USA, Brochure entitled "Parts Jamming Booths," published prior to Jul. 28, 2005 (1 page).

Garmat® USA, Brochure entitled "Quantum™ Parts Jamming Tunnels," published prior to Jul. 28, 2005 (4 pages).

Garmat® USA, Brochure entitled "Self Contained Downdraft Spray Booth," published prior to Jul. 28, 2005 (4 pages).

Garmat® USA, Brochure entitled "Tier 1 Spray Booths Preparation Areas Paint Mixing Rooms," published prior to Jul. 28, 2005 (4 pages).

Garmat® USA, Brochure entitled "10400 Series Preparation Areas," published prior to Jul. 28, 2005 (1 page).

Garmat® USA, Brochure entitled "Accele Cure," published prior to Jul. 28, 2005 (1 page).

Garmat® USA, Brochure entitled "Chinook II Paint Booths," published prior to Jul. 28, 2005 (1 page).

Garmat® USA, Brochure entitled "99700 Series Paint Booths," published prior to Jul. 28, 2005 (2 pages).

Garmat® USA, Brochure entitled "Xpress Cure™ UV Curing System From the Experts in Ultraviolet Lights," published prior to Jul. 28, 2005 (2 pages).

Garmat® USA, Brochure entitled "Touch Screen Controller the Hi-Tech Touch Screen Control Panel," published prior to Jul. 28, 2005 (1 page).

* cited by examiner

UV CURING STRUCTURE AND PROCESS

BACKGROUND OF THE INVENTION

Most metallic and many plastic surfaces of useful articles are painted to prevent weathering and corrosion and for decorative reasons. One common way to paint a large object, e.g. an automobile or automobile part, is by using a housing or booth in which the paint is sprayed on the object. The object then usually remains in the booth while the paint is cured by heating or other means. Such paint spray booths are commonly prefabricated building structures having a ceiling, floor and walls that define an interior space large enough to hold the object to be painted, with sufficient room on all sides for workmen to effectively operate paint spray and other equipment. These booths provide advantages such as reducing particulates, confining paint overspray and evaporated solvents and reducing drying times.

One common type of paint spray booth is the downdraft and semi-vertical spray booth that uses a housing positioned over an open floor grate or an exhaust outlet near the bottom of the walls. Air from the ceiling and any entrained paint overspray and solvents are drawn downward over the vehicle during spraying and drying and are then exhausted through the floor grate or exhaust opening. One example of such a spray booth is described in U.S. Pat. No. 6,533,654, incorporated herein by reference. Curing of the paint applied to the object is usually accomplished by using heaters to increase the temperature within the booth. The paint curing time in conventional paint spray booths may take about one hour.

Materials that are cured (hardened) by exposure to light have recently shown promise in a variety of industries because such materials have very short cure times without the application of heat, and have several advantages in speed and ease of use. Some of the general benefits of light-cured materials include rapid curing times (in some cases almost instantaneous, allowing for immediate further processing), on demand curing (requiring only exposure to UV light), no solvents (100% solids—no environmental pollution due to solvent evaporation), no heat (low thermal stressing of substrate materials), single component systems (ready-to-use with no mixing, no waste, no cleaning of mixing containers, no problems with pot life or mixed materials, no dangerous isocyanate catalysts), and more efficient use of raw materials and energy. Examples of light-cured materials include structural adhesives for bonding glass, ceramics, ferrites, plastics and metals; UV hot melt pressure sensitive adhesives; UV glob tops, chip coats and conformal coatings; UV potting compounds and encapsulants; UV paints, inks and coatings; and UV hardening polyester resin/glass fiber composite materials.

The use of light-cured materials can be found in an extremely wide variety of industries such as, for example, the electronics, printing, furniture, floor covering, medical device, dental, packaging, marine and paper industries. The use of light-cured paints and coatings in the automotive refinish and repair markets has grown considerably in recent years, but to date has typically been limited to primer applications. However, it is likely that light-cured products will be expanded to possibly include basecoats, topcoats, fillers and glazes, adhesives and sealers.

Light-cured materials contain chemicals known as photo initiators that comprise certain reactive groups, e.g. acrylate or methacrylate groups, which are sensitive to UV radiation. When photo initiators are illuminated with intense UV light, they initiate a polymerization reaction that hardens the material. If a light-cured material is used as a paint or other coating to cover an object, the hardened material provides a protective finished surface, or one that is ready for sanding and application of other coats in a short period of time, e.g. in about 2-5 minutes.

Curing of light-cured materials currently requires the use of a UV lamp. These UV lamps typically use a relatively small high-intensity discharge (HID) quartz bulb that is filled with mercury and traces of other elements. A high voltage applied to electrodes in the lamp creates an arc that heats the gaseous atoms to the point at which they emit UV light, visible light and infrared light. Full intensity is usually reached within about 2-5 minutes. The bulb is positioned inside a reflector that collects and focuses the light toward the lamp opening, which is typically designed to filter out more-harmful UV-B and UV-C radiation and allow only UV-A radiation to be emitted by the lamp.

UV-curing lamps have certain disadvantages. In addition to being relatively expensive, the HID bulbs slowly decrease in light output over time (thereby causing progressively longer cure times) and should be replaced after about 500 hours of use. It is recommended to turn off the bulb immediately after each use to maximize bulb life, minimize stray UV radiation, heat buildup in the workplace, and make the lamp easier to handle and move. UV-curing lamps are intended to be used only in a restricted area, accessed only by qualified professional operators, due to the dangers of being exposed to the emitted UV radiation and the generation of ozone by the lamp. In addition, UV lamps generally only have a very limited exposure area or footprint. Currently the coverage area of UV-curing lamps may be limited to an area of about 6 square feet, which results in frequent repositioning of the lamp. Although this disadvantage may be limited somewhat by mounting the lamp on a computer guided robot which automatically repositions the lamp to a different exposure area, this solution is very expensive.

BRIEF SUMMARY OF THE INVENTION

The present invention is directed to structures and methods of curing light-cured materials without requiring the use of UV-curing lamps. As used herein, a "light-cured" material is intended to include any of the many materials known or to be developed that may be hardened by exposure to light including UV radiation. It is contemplated that the present invention may be useful for any of the known applications for light-cured materials. In particular, the present invention provides structures and methods that are useful for applying and curing light-cured paints in the automotive industry.

In accordance with one aspect of the invention, a structure is provided for curing a light-curable material that has been applied to an object, e.g. a UV-curable paint that has been applied to an automobile or automobile part. In its most basic form, the structure comprises a framework that defines an interior space for containing the object to which the light-curable material has been applied, and means associated with the framework for exposing the object to UV radiation obtained from, e.g., natural sunlight and/or UV LEDs.

In one embodiment, the framework may comprise a housing wherein the UV radiation-exposing means comprises one or more transparent windows in a ceiling exposed to sunlight and configured to transmit UV radiation from the sunlight to the object contained within the housing. In a preferable embodiment, the ceiling comprises a substantially horizontal opaque middle section connected to side sections on either side thereof which contain the windows. In another embodiment, the side sections may be slanted towards the walls of the housing. The middle section of the ceiling may be used to house desired apparatus, e.g. air circulation apparatus.

Since light-cured materials are usually inactive and stable only in the absence of UV light, application of the paint to the object may require conditions void of UV radiation. Accordingly, the application of the light-cured material may be accomplished in a light-tight structure that is separate from the structure in which the light-cured material is cured. One preferred embodiment of the present invention comprises a single structure in which the light-cured material can be both applied to the object and cured. Exemplary spray booths comprise a housing having a ceiling, a floor and one or more walls on the sides, front and/or rear of the housing, any of which may optionally have one or more doors and/or windows therein. Alternatively, in place of walls, the spray booth may have one or more curtains that drape from the periphery of the ceiling and may be drawn to form an enclosure around the object to be painted and cured. Preferred spray booths may have means to introduce filtered air into the interior of the booth from the ceiling and to exhaust the air through an exhaust outlet near the floor, thereby creating an air flow gradient within the interior to facilitate downdraft conditions in the booth.

In one spray booth embodiment of the invention, sunlight comprising UV radiation may directed to the coated object during curing by one or more skylight tube systems, each comprising a sunlight collector positioned external to the spray booth, a sunlight exposer positioned within the interior space containing the coated object, and a light transmitting conduit that connects the sunlight collector with the exposer and passes through the spray booth structure. In a preferred embodiment, the conduit(s) passes through a wall of the spray booth, or through a portion of the ceiling that does not interfere with apparatus that is contained in or above the ceiling, e.g. for introducing air into the interior of the booth.

The sunlight collector may comprise a clear dome of UV radiation-transmitting material or any other apparatus that captures sunlight rays and directs them toward the light-transmitting conduit. The light-transmitting conduit may comprise a tubular or other shaped lumen having a highly reflective interior surface that directs the collected sunlight toward the exposer at the end of the conduit opposite the sunlight collector. The light-transmitting conduit may also comprise other light-transmitting media such as a fiber optic cable. The exposer may comprise a diffuser that spreads the sunlight throughout the interior of the spray booth or may have associated therewith means for directing the sunlight to a particular location within the booth.

Any or all of the components of the skylight tube system may comprise means for modifying the sunlight (and/or UV radiation component thereof) that is collected and transmitted to the coated object. For example, the booth of the present invention may preferably include an optical directing system that directs UV radiation from the exposer(s) over the entire painted surface of the object contained therein.

DETAILED DESCRIPTION OF THE INVENTION

The present invention provides apparatus and methods for curing light-cured materials with natural sunlight containing UV radiation. Preferred embodiments of the invention provide apparatus and methods for applying a light-cured material to an object in a structure and curing the material in the same structure. The following detailed description is directed specifically to several preferred embodiments useful for applying light-cured paints and other coatings to the surface of automobiles or automobile parts, but one skilled in the art will readily recognize other applications for the invention.

As previously described, light-cured materials such as adhesives, inks, paints and other coatings are known in the art and commercially available. For example, light-cured coatings suitable for the automotive and other industries are currently available from Azko Nobel, BASF, DuPont, Montana Products, PPG, NEXA Autocolor and Ciba Specialty Chemicals. It is contemplated that any of such light-cured materials may be used in the practice of the present invention.

Figure 1:
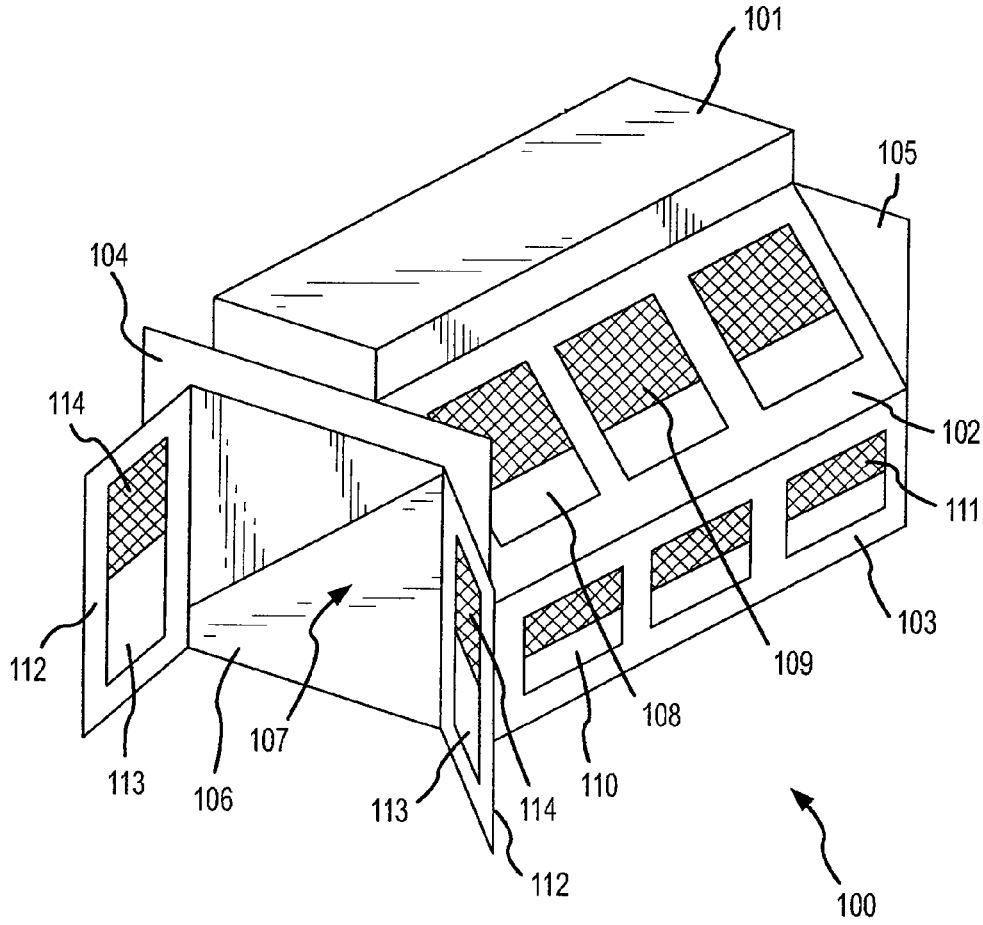
FIG. 1 is a perspective view of one embodiment of a structure according to the invention.

FIG. 1 illustrates one embodiment of the present invention. Booth 100 is a free-standing structure suitable for an outside location directly exposed to sunlight, and may be used to cure a light-cured material that has been previously applied to an object at another location, or preferably, may be used for both the application of a light-cured material and for curing the material after application. Booth 100 comprises a housing having a ceiling with a substantially horizontal middle section 101 and slanted side sections 102. The ceiling is supported by side walls 103, front wall 104 and rear wall 105, which together with floor 106 define interior space 107. Slanted ceiling sections 102 may contain one or more transparent windows 108 that are exposed to direct sunlight and are configured to transmit UV radiation from the direct sunlight to an object located within interior space 107. Side walls 103 may also contain one or more transparent windows 110 that are exposed to ambient or indirect sunlight, and are configured to transmit UV radiation from the sunlight to an object located within interior space 107. Exposure to UV radiation in the sunlight entering interior space 107 in the various ways described initiates a hardening reaction in the light-cured material applied to the object, thereby curing the material.

If booth 100 is used for application of light-cured material, ceiling windows 108 may be fitted with retractable interior shades 109, and side windows 110 may fitted with retractable interior shades 111. Front wall 104 and rear wall 105 may include doors 112, which may have one or more transparent windows 113, also fitted with retractable interior shades 114 if required.

Figure 2A:
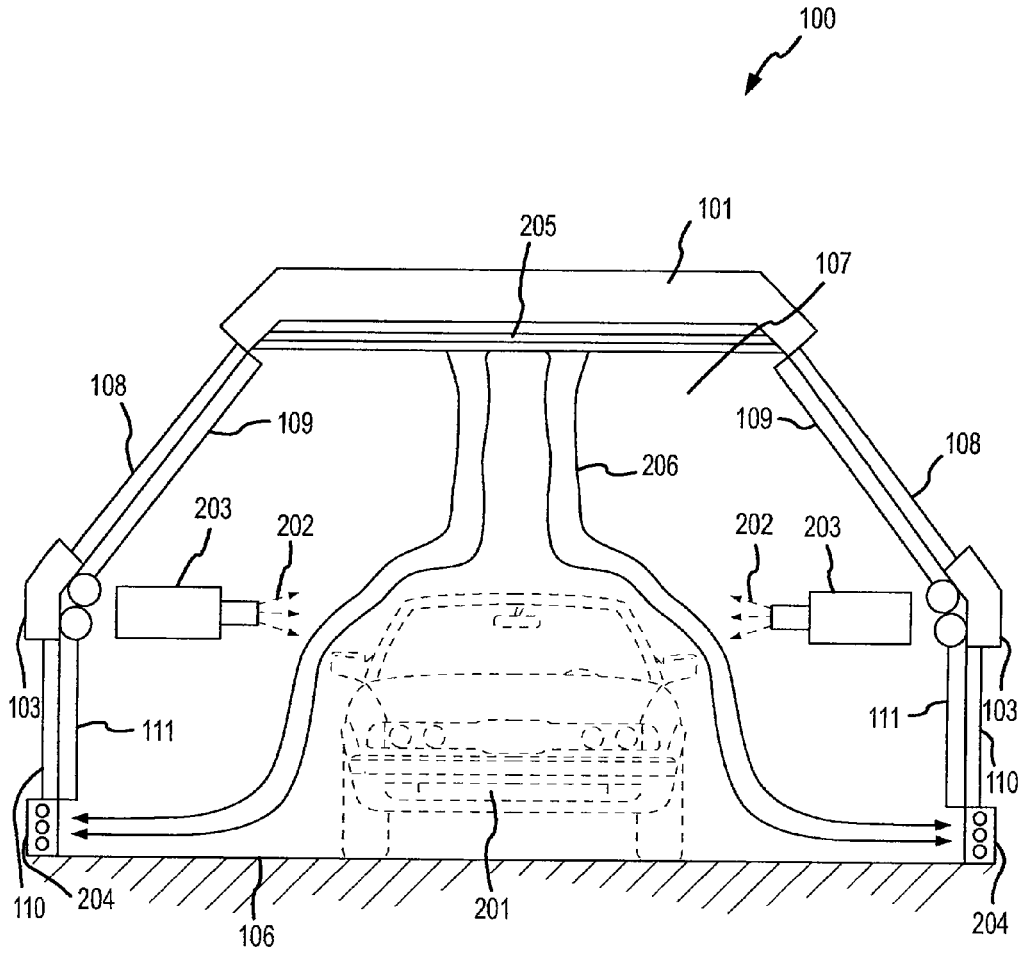
FIG. 2A is a cross-section view of the structure shown in FIG. 1 during the application of a light-cured paint to an automobile.
Figure 2B:
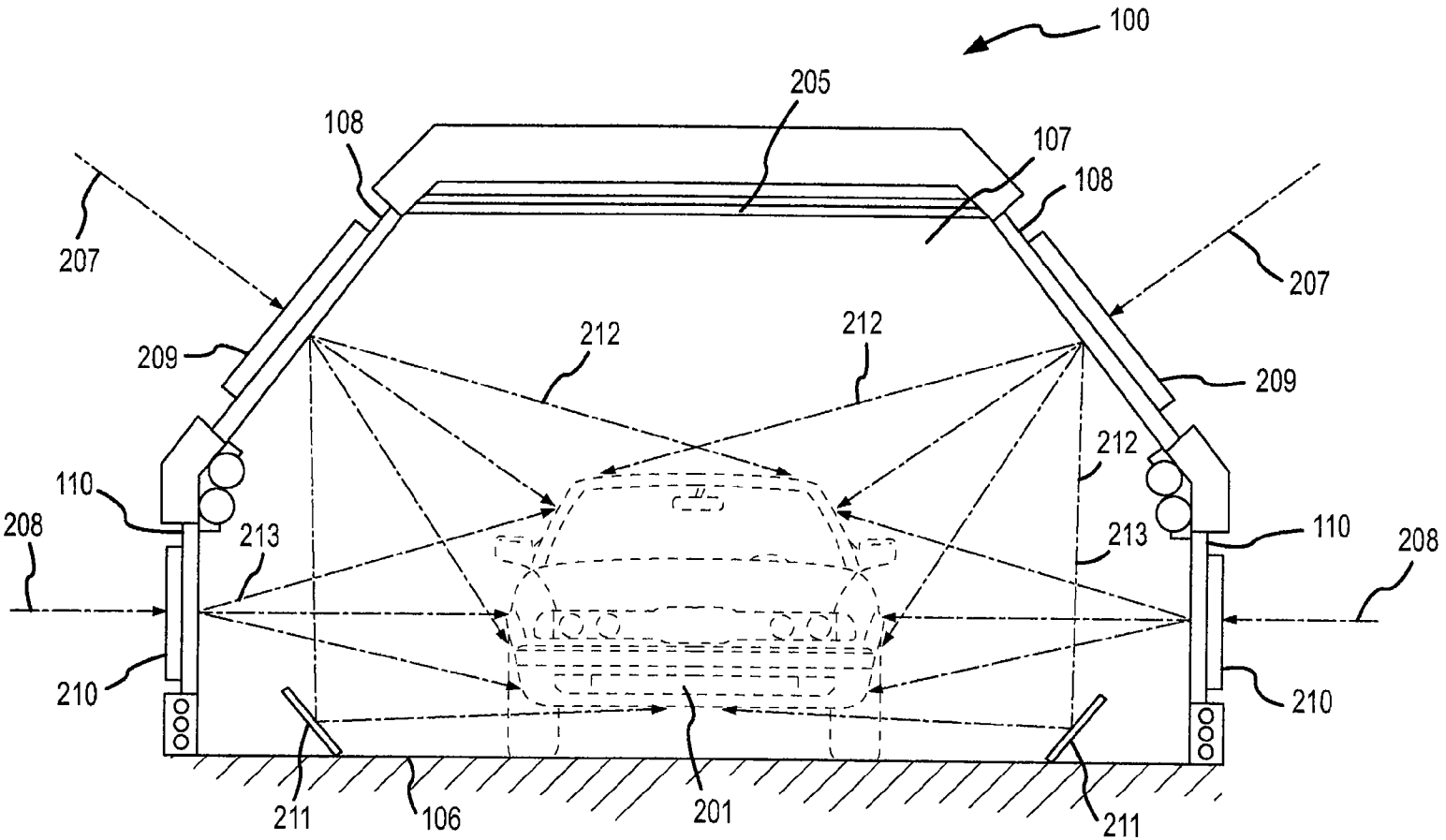
FIG. 2B is a cross-section view of the structure shown in FIG. 1 during the curing of the light-cured material applied to an automobile.

As an illustrative example, the operation of booth 100 during the application of a UV-curable paint to an automobile (or other object) will be described in connection with FIG. 2A, and the operation of booth 100 during the curing of that paint after application will be described in connection with FIG. 2B. FIG. 2A and 2B use the same reference numbers as used in FIG. 1 to refer to the same elements. To begin the paint application process, the automobile is placed within interior space 107 of booth 100 after appropriate surface preparation using conventional procedures known in the art. A conventional UV-curable paint 202 may be applied to the surface of automobile 201 using paint applicator(s) 203. Paint applicator(s) 203 may comprise any of the manually operated or automated paint spray guns or other applicators known to the art as being suitable for the application of UV-curable paint. For example, paint applicator(s) 203 may comprise known aerosol application equipment that eliminates the need for measuring and mixing and makes preparation and cleaning of a paint spray gun unnecessary.

UV-curable paints are usually applied to an object in the absence of UV-radiation to prevent premature curing. Accordingly, during the paint application process illustrated in FIG. 2A, retractable interior shades 109 may be drawn over windows 108, retractable interior shades 111 may be drawn over windows 110, and retractable interior shades 114 may be drawn over windows 113 (FIG. 2) to prevent sunlight from entering interior space 107. Retractable shades 109, 111 and 114 may be positioned on the interior of the windows so that they can also serve to protect windows 108, 110 and 113, respectively, from being covered by any paint overspray. Illumination of interior space 107 during the application process may be accomplished by using a light source having a wavelength to which the photo initiators in the UV-curable paint are not sensitive, but which is (or can be made) visible to the human eye or suitable video monitoring equipment.

Booth 100 may be of the type that is positioned over an open grate in floor 106, or preferably booth 100 uses exhaust outlets 204 near the bottom of side walls 103 (as shown). An air intake and circulation system 205 may be disposed in ceiling section 101 and is adapted to supply air 206 into the interior space 107. During application of the paint to automobile 201, circulation system 205 causes air 206, as well as any paint overspray, to be drawn downward over automobile 201 and to be exhausted through exhaust outlets 204. Air circulation system 205 may also be used to enhance air flow over automobile 201 during the curing process, if desired. Examples of preferred downdraft spray booths are described in U.S. Pat. No. 6,533,654, and co-pending applications Ser. No. (019254-001110US) and Ser. No. (019254-001120US), all of which are incorporated by reference herein.

The UV curing process will now be described with reference to FIG. 2B. After the application of the UV-curable paint and any required post-application surface preparation, retractable shades 109, 111 and 114 (FIG. 2) may be put in their retracted or open position, as shown in FIG. 2B. This open position allows direct sunlight 207 comprising UV radiation to pass through windows 108, and ambient sunlight 208 comprising UV radiation to pass through windows 110. Optical elements 209 may be optionally positioned in the path of direct sunlight 207 and optical elements 210 may be positioned in the path of ambient sunlight 208, so as to modify the radiation entering interior space 107 and provide enhanced UV radiation 212 and 213.

As used herein, including the appended claims, the phrase "to modify the radiation"means to direct, filter, magnify, concentrate, diffuse and/or otherwise change the character of the radiation as required by any particular application. One may wish to modify the radiation for various reasons, e.g. to accommodate the size, shape and other characteristics of automobile (or other object) 201 and/or to accommodate the properties of the UV-curable paint being cured. As one example, optical elements 209 and 210 may comprise lenses, reflective devices and/or light diffusers to direct enhanced UV radiation 212 and 213 in a manner that assures complete exposure of all of the coated surfaces of automobile (or other object) 201. As another example, optical elements 209 and 210 may comprise filters to block out certain wavelengths of radiation from entering interior space 107 and exposing the coated surfaces of automobile 201, e.g. UV-B and UV-C radiation may be filtered out of sunlight 207 and enhanced UV radiation 212 and 213 may comprise only UV-A radiation. As a still further example, optical elements 209 and 210 may magnify or concentrate sunlight 207 so that enhanced UV radiation 212 and 213 is more intense than the UV radiation naturally present in sunlight 207. Similar optical devices may also be included within interior space 107, e.g. reflective devices 211 may be included on floor 106 to direct enhanced UV radiation 212 to the underside of automobile 201, or placed in other locations so to direct enhanced UV radiation 212 and 213 to various other coated surfaces of automobile 201. As previously mentioned, air circulation system 205 may optionally be used to enhance air flow over automobile 204 during the curing process, if needed or desirable.

Figure 3:
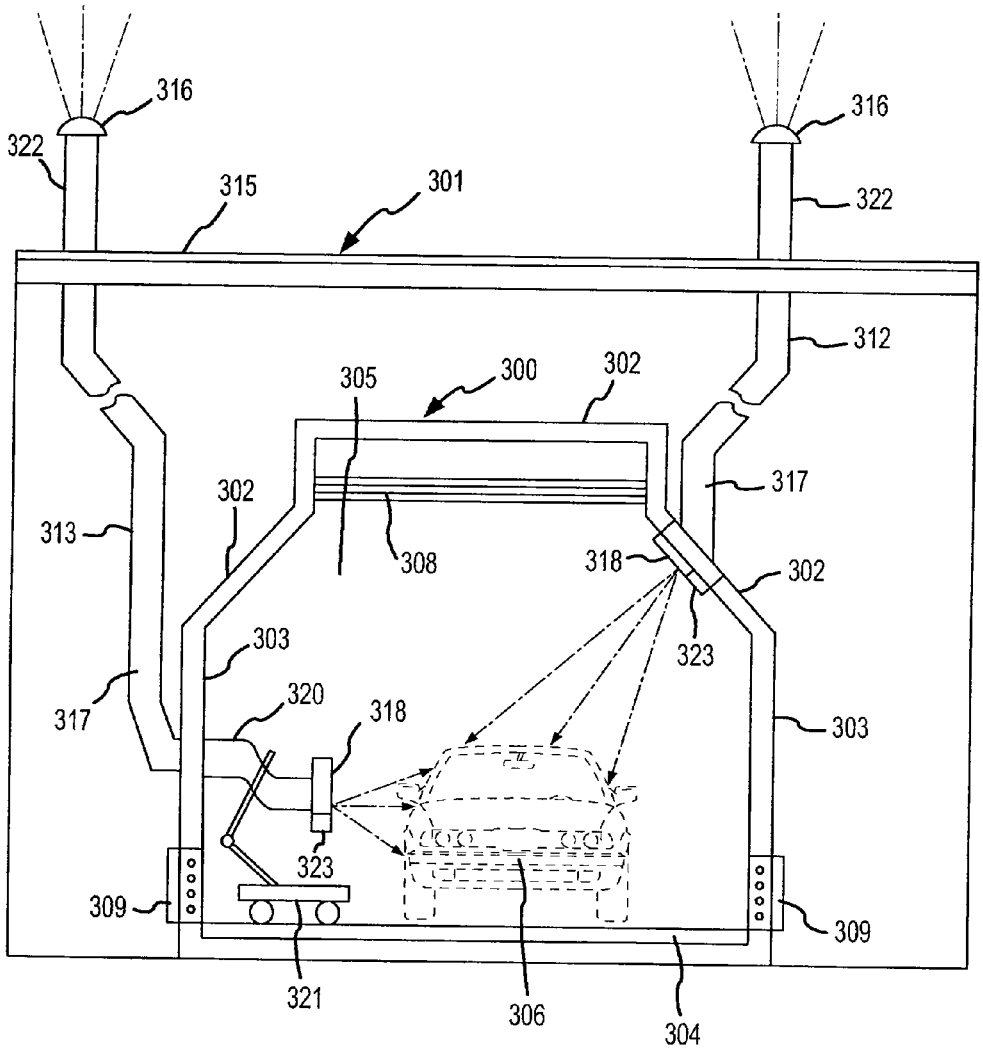
FIG. 3 is a cross-section view of another embodiment of a structure according to present invention.

FIG. 3 illustrates another embodiment of the invention wherein booth 300 is located inside a larger building structure 301. Booth 300 comprises ceiling 302, side walls 303, floor 304 and front and rear walls (not shown), which together define interior space 305 for holding automobile 306 to be painted and cured. Interior space 305 may contain any or all of the same elements as previously described in connection with booth 100, i.e. UV paint applicators (not shown), air circulation system 308, exhaust outlets 309 and reflective devices 310 (not shown).

One or more skylight tube systems 312 may extend through roof 315 of building 301 and through ceiling 302 of booth 300, and/or one or more skylight tube systems 313 may extend through roof 315 and through side walls 303 of booth 300. Each skylight tube system respectively comprises a sunlight collector 316, a light-transmitting conduit 317 and an exposer 318. Skylight tube systems contemplated as being suitable for use in the present invention are commercially available from a wide variety of companies. As examples, mention may be made of skylight tube systems sold under the trademarks Solatube, SunPipe, Daylite and SunTunnel.

Sunlight collector 316 may be mounted external to booth 300, e.g. sunlight collector 316 may be conveniently located on roof 315 of building 301 directly exposed to sunlight. Sunlight collector 316 may be mounted on a device that positions it in the best possible location for receiving sunlight throughout the day, e.g. sunlight collector 316 may be mounted on the top of extension 322 that places sunlight collector 316 about 3 feet or more above roof 315. Sunlight collector 316 may comprise a clear dome of sunlight-transmitting material, and may also optionally comprise reflectors mounted external or within the dome, and/or lenses and other known means for enhancing the capture of sunlight and the transmission thereof towards the light-transmitting conduit 317. Filters or other optical devices may also be associated with sunlight collector 316 to modify the radiation transmitted down the light-transmitting conduit 317.

Light-transmitting conduit 317 may comprise a tubular or other shaped lumen with a highly reflective interior surface adapted to direct collected sunlight down the lumen and out the diffuser at the opposite end. Light-transmitting conduit 317 is connected at one end to sunlight collector 316 and at the opposite end to exposer 318, and may comprise a rigid or flexible tube or channel. For example, light-transmitting conduit 317 may be a tube of about 10-21 inches in diameter and made from aluminum. The interior surface of light-transmitting conduit 317 may be coated with a reflective material, for example silver or a material containing silver. Examples of commercially available reflective tube materials include those sold under the trademarks Alcoa Everbrite 95 and 3M Siverlux. It is also contemplated that light-transmitting conduits 317 may comprise a fiber-optic cable or other device.

Exposer 318 may be mounted on the interior of wall 303 or ceiling 302 of booth 300, and may comprise a light diffuser that spreads the light coming through light-transmitting conduit 317 throughout interior space 305. In addition, one or more exposers 319 may be mounted on the end of a flexible reflective tube 320 extending from light-transmitting conduit 317, thereby allowing exposer 319 to be moved around automobile 306, e.g. by robot 321, to achieve a more complete exposure of hard-to-reach surfaces of automobile 306.

At least one of the components of the skylight tube systems may be fitted with means for blocking UV radiation from exposing automobile 306 during the application of UV-curable paint. As one example, exposer 318 may be fitted with a retractable cover 323 that covers exposer 318 during the application process, but which may be retracted to uncover exposer 318 during the curing process. In addition, one or more of the skylight tube system components may include any of the previously mentioned optical devices used to modify the radiation contained in the sunlight transmitted thereby.

In another embodiment, the present invention provides a method of curing a light-cured material which comprises the steps of applying a light-cured material to an object; placing the object in an interior space of a structure having associated therewith means for transmitting UV radiation from natural sunlight into the interior space; and exposing the object to said UV radiation. A preferred method comprises applying the light-cured material to the object after it is located in the interior space of the structure and blocking the UV radiation from being transmitted into the interior space during said application. As previously described, preferred methods comprise transmitting UV radiation into the interior space through one or more windows in the structure, and transmitting UV radiation into the interior space through one or more skylight tube systems.

Embodiments of the invention have been described in detail for the purposes of clarity and understanding. However, it will be appreciated that certain changes and modifications may be practiced within the scope of the appended claims.

What is claimed is:

1. A method of curing a light-curable material which comprises:

placing an object having a light-curable material applied thereon within an enclosed interior space of a structure defined by a ceiling, at least one support for the ceiling, and a plurality of walls, wherein the structure includes at least one skylight tube system that comprises a sunlight collector disposed external to the structure for collecting sunlight, a light-transmitting conduit extending through the structure and a first exposer with a light diffuser mounted to one of the walls, wherein the skylight tube system further comprises a flexible tube having a second exposer that is movable within the interior space; and directing UV radiation from sunlight into the interior space to expose the object to UV radiation, wherein the directing step comprises permitting UV radiation from the first exposer to spread via the diffuser throughout the interior space, and moving the second exposer around the object to specifically direct UV radiation onto the object to provide a more complete exposure of the object to UV radiation.

2. A method as in claim 1 further comprising creating a downdraft environment over the object using filtered air entering through the ceiling and exiting near a bottom of the structure.

3. A method as in claim 1 further comprising applying the light-curable material after the object is placed in the interior space of the structure, and blocking UV radiation from being directed into the interior space during such application.

4. A method as in claim 1 wherein the UV radiation is directed into the interior space by the second exposer using a robot that is housed within the interior space.

5. A method as in claim 1 wherein the UV radiation is modified before the object is exposed.

6. A method as in claim 1 wherein the object is an automobile coated with a UV-curable paint.

7. A method of curing a light-curable material which comprises:

placing an object having a light-curable material applied thereon within an enclosed interior space of a structure defined by a ceiling, at least one support for the ceiling, and a plurality of walls, wherein the structure includes at least one skylight tube system that comprises a sunlight collector disposed external to the structure for collecting sunlight, a light-transmitting conduit extending through the structure, and a flexible tube having an exposer that is movable within the interior space; and directing UV radiation from sunlight into the interior space to expose the object to UV radiation, wherein the directing step comprises moving the exposer around the object to specifically direct UV radiation onto the object to expose the object to UV radiation.

8. A method as in claim 7 wherein the UV radiation is directed into the interior space by the exposer using a robot that is housed within the interior space.

* * * * *